US005289076A

United States Patent [19]

Lee

[11] Patent Number: 5,289,076

[45] Date of Patent: Feb. 22, 1994

[54] CATHODE STRUCTURE FOR A CATHODE RAY TUBE

[75] Inventor: Gyeong S. Lee, Kyungsangbook-Do, Rep. of Korea

[73] Assignee: GoldStar Co. Ltd., Rep. of Korea

[21] Appl. No.: 808,493

[22] Filed: Dec. 17, 1991

[30] Foreign Application Priority Data

Dec. 24, 1990 [KR] Rep. of Korea ..... 90-20820

[51] Int. Cl.[5] ..... H01J 1/24

[52] U.S. Cl. ..... 313/37; 313/45; 313/46; 313/239; 313/270; 313/337; 313/346 R

[58] Field of Search ..... 313/37, 38, 44, 45, 313/239, 244, 252, 263, 310, 337, 270, 346 R, 356, 46, 47

[56] References Cited

U.S. PATENT DOCUMENTS 2,833,952 5/1958 Hemphill et al. ..... 313/270 X 3,354,340 11/1967 Almer et al. ..... 313/270 X

FOREIGN PATENT DOCUMENTS 60-264019 12/1985 Japan .

*Primary Examiner*—Donald J. Yusko
*Assistant Examiner*—Ashok Patel
*Attorney, Agent, or Firm*—Morgan & Finnegan

[57] ABSTRACT

A cathode structure for supporting a cathode sleeve of a cathode ray tube includes a plurality of metal ribbons for supporting the cathode sleeve, where one end of a ribbon is fixed to an upper end of the cathode sleeve and the other end of the same ribbon is fixed to an upper end of a cathode holder, that allows thermal expansion of the cathode sleeve to occur towards the cathode holder, and maintain a constant distance between a cathode cup on the cathode sleeve and a first electrode of an electron gun.

1 Claim, 2 Drawing Sheets

CATHODE STRUCTURE FOR A CATHODE RAY TUBE

FIELD OF THE INVENTION

The present invention concerns a cathode structure for a cathode ray tube, and more particularly a supporting means for fixing a cathode sleeve to a cathode holder.

BACKGROUND OF THE INVENTION

Although the conventional cathode for a cathode ray tube has employed a base cathode structure of nickel (Ni) containing a trace of reducing material coated with an electron emissive substance, recently a cathode of an impregnate type is widely used in order to accommodate to the recent trend that an electron tube has a high resolution and a large screen size requiring a high intensity of the cathode currents. The impregnate type cathode may carry a high cathode current, but should be made of a refractory metal such as molybdenum (Mo) due to the high operating temperature of about 1050°-1200° C., and moreover suffers an adverse volume change because of the high temperature.

The cathode structure of an impregnate type generally comprises, as shown in FIG. 1, a pellet 11 of refractory porous sintered body impregnated with an electron emissive substance, a cathode cup 12 of a refractory metal for containing the pellet, a cylindrical cathode sleeve 13 of a refractory metal for receiving the cathode cup 12 in the upper opening, a cathode holder 14 for holding the cathode sleeve 13 outwardly, a plurality of metal ribbons 15, 15' and 15'' for fixing the cathode sleeve 13 to the cathode holder 14, the cathode support 16, and a heater 17 mounted inside the cathode sleeve.

Ends of the metal ribbons are fixed to the lower end of the cathode sleeve 13, and the other ends to the upper end of the cathode holder 14, so that the cathode sleeve 13 is held by the cathode holder 14.

The cathode holder 14 is supported in the cathode supporter 16 of an electron gun assembly.

In another embodiment of the conventional cathode structure, the pellet 11 of refractory porous sintered body is set in a cathode ring attached on the upper closed end of a cathode sleeve.

In this conventional cathode structure, the reason that the metal ribbons 15 connect the cathode sleeve 13 and cathode holder 14 is to prevent the heat transferred from the heater 17 to the cathode sleeve 13 from being further transferred to the cathode holder 14. Namely, it is very important to prevent the heat generated by the heater 17 from being lost towards the outside because the time being taken for the image to appear on the screen of a cathode ray tube depends upon the electron emission of the impregnate pellet 11 that is caused by the heat transferred from the heater 17 to the impregnate pellet 11. Furthermore, if the heat lose is reduced, the power consumption of the heater may also be reduced together with the thermal distortion of the cathode structure, thus achieving a high luminance and resolution of the screen image.

To achieve this end, there has been proposed the blackening of the cathode sleeve 13 for increasing the heat radiation. The blackening of the cathode sleeve 13 is generally achieved by oxidizing the chromium (Cr) component of the cathode sleeve made of Ni-Cr alloy in a wet hydrogen atmosphere at a temperature of about 1100° C. However, the conventional impregnate cathode structure wherein the cathode sleeve 13 is fixed to the cathode holder 14 by means of the metal ribbons 15 induces problems related to the thermal distortion in a cathode sleeve 13 of Ni-Cr alloy. Namely, since the melting point of the Ni-Cr alloy is about 1400° C. and the activation temperature of the electron emissive substance is about 1200° C., the high operating temperature of the electron emissive substance easily causes the thermal distortion of the cathode sleeve 13 of Ni-Cr alloy.

Moreover, since the lower end of the cathode sleeve is fixed to the cathode holder, the thermal expansion of the cathode sleeve caused by the high operating temperature of the electron emissive substance occurs upwardly in the direction of the impregnate pellet 11 changing the gap between the impregnate pellet 11 and the first electrode of an electron gun (not shown) opposing it, thereby the cathode current is changed to cause the variations of the screen image of a cathode ray tube.

Hence, it is not suitable to employ the cathode sleeve of Ni-Cr alloy in the conventional impregnate cathode structure. There has been proposed a further embodiment of the conventional cathode structure wherein the cathode sleeve is made of a refractory metal such as molybdenum (Mo) and tantalum (Ta) in order to satisfy the requirements of the high cathode current. However, the cathode sleeve made of such refractory metal is very difficult to blacken for reducing the time being taken for the image to appear on the screen, and needs a relatively high cost.

SUMMARY OF THE INVENTION

It is an object of the present invention to provide a cathode structure properly used in a cathode ray tube requiring a high cathode current.

It is another object of the present invention to provide a cathode structure whereby the cathode current is stabilized by minimizing the variations of the cathode current.

It is still another object of the present invention to provide a cathode structure whereby the screen image is stabilized by reducing the screen image appearing time and the amount of the thermal expansion of the cathode sleeve.

According to the present invention, there is provided a cathode structure for a cathode ray tube comprising a cathode cup containing an electron emissive substance for emitting thermal electrons, a cathode sleeve for receiving the cathode cup to transfer the heat from a heat source to the cathode cup, a cathode holder for holding the cathode sleeve outwardly, and a plurality of metal ribbons for supporting the cathode sleeve to the cathode holder with ends of the ribbons fixed to the upper end of the cathode sleeve and the other ends to the upper end of the cathode holder, thereby causing the thermal expansion of the cathode sleeve to occur towards the cathode holder so as to maintain a constant gap between the cathode cup and the first electrode of an electron gun.

The present invention will now be described with reference to the drawings attached only by way of example.

BRIEF DESCRIPTION OF THE ATTACHED DRAWINGS

DETAILED DESCRIPTION OF THE INVENTION

Figure 1A:
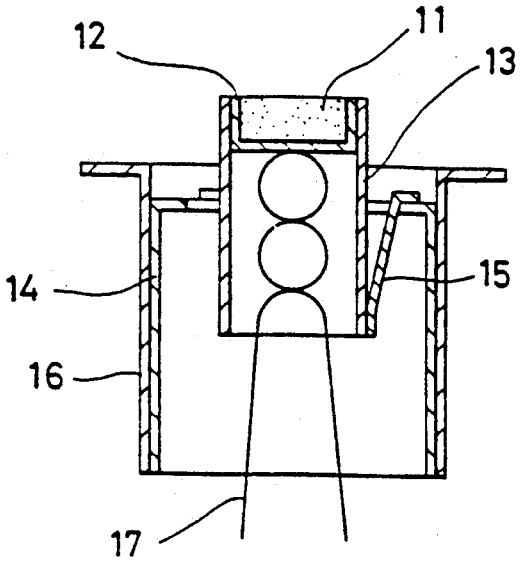
FIG. 1A is a cross sectional view of a conventional cathode structure used in a cathode ray tube.
Figure 1B:
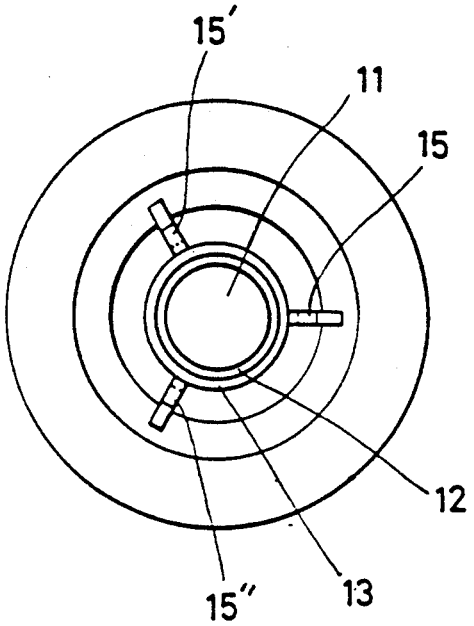
FIG. 1B is a plane view of the conventional cathode structure of FIG. 1A.
Figure 2A:
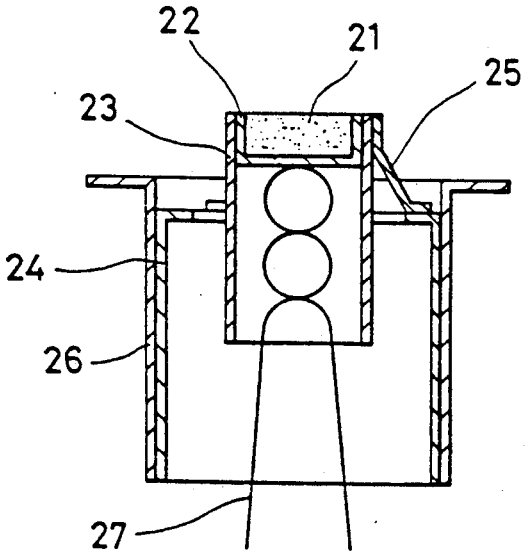
FIG. 2A is a cross sectional view of the cathode structure according to an embodiment of the present invention.
Figure 2B:
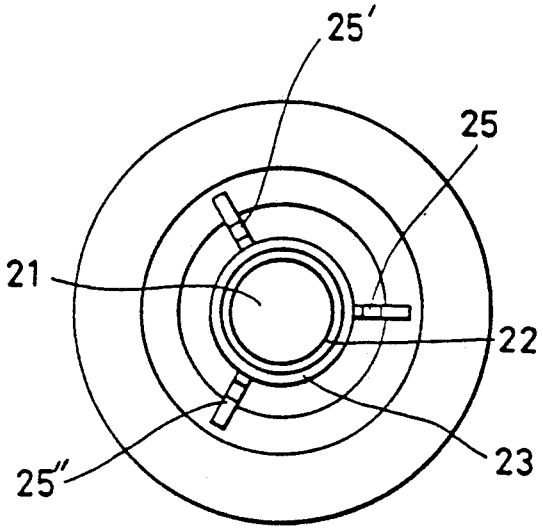
FIG. 2B is a plane view of a cathode structure of FIG. 2A.

There is shown in FIGS. 2A and 2B an impregnate cathode structure according to the present invention. An impregnate pellet 21 is made of a refractory porous sintered body, and is contained in a cathode cup 22. The cathode cup 22 is inserted in the upper opening of a cylindrical cathode sleeve 23 that is held by a cathode holder 24. There is shown a heater 27 in the inside of the cathode sleeve 23. A plurality of metal ribbons 25 are used to fix the cathode sleeve to the cathode holder, which in turn is mounted inside the cathode supporter 26 of an electron gun assembly. The cathode cup and metal ribbons are made of a suitable refractory metal such as Mo and Ta, and ends of the metal ribbons are attached to the upper end of the cathode sleeve and the other ends to the upper end of the cathode holder. The cathode sleeve is made of Ni-Cr alloy in order to improve the radiation efficiency of the heater, and is blackened by oxidizing the Cr component in a wet hydrogen atmosphere at the temperature of about 1100°C. As stated above, since the upper end of the cathode sleeve is fixed to ends of the metal ribbons whose other ends are fixed to the upper end of the cathode holder, the thermal expansion of the length of the cathode sleeve occurs downwards into the cathode supporter 26, the original gap between the impregnate pellet and the first electrode of the electron gun is not changed, thereby providing stable screen images.

On the contrary, the cathode sleeve of the conventional cathode structure is made of a refractory metal such as Mo held by the cathode holder by means of the metal ribbons whose one ends is fixed to the lower end of the cathode sleeve and other ends to the upper end of the cathode holder by welding, which complicates the manufacturing process. Namely, welding the lower end of the cathode sleeve made of such metal as Mo, etc. and the metal ribbons inside the cathode holder is more difficult than welding the upper end of the cathode sleeve and the metal ribbons outside the cathode holder as in the inventive structure. In other words, the cathode sleeve of the present invention is made of Ni-Cr alloy, and the metal ribbons are fixed to the upper end of the cathode sleeve outside the cathode holder, thus simplifying the manufacturing process.

Figure 3A:
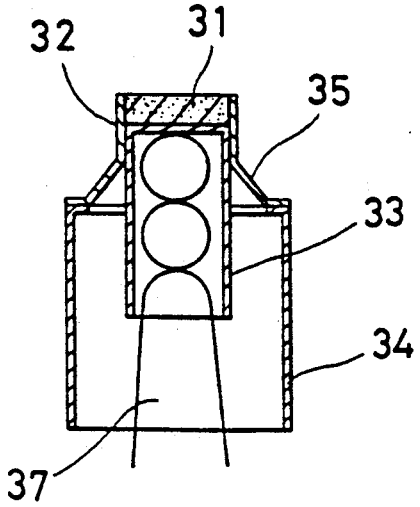
FIG. 3A is a cross sectional view of the cathode structure according to another embodiment of the present invention.
Figure 3B:
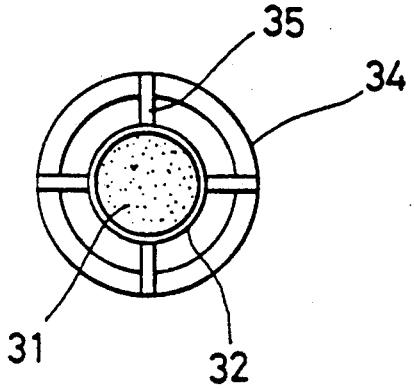
FIG. 3B is a plane view of the cathode structure of FIG. 3A.

In another embodiment of FIGS. 3A and 3B, the cathode cup 32 containing the impregnate pellet 31 is fixed to the upper closed end of the cathode sleeve 33, and has metal ribbons 35 extended therefrom. Namely, the metal ribbons 35 extended from the cathode cup 32 have ends fixed to the upper side wall of the cathode sleeve 33 and the other ends to the upper end of the cathode holder 34.

Figure 4A:
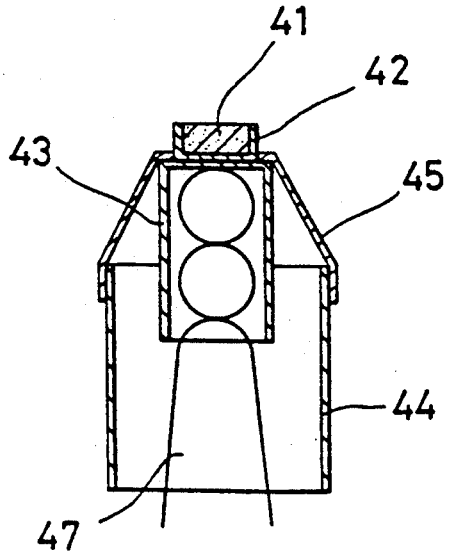
FIG. 4A is a cross sectional view of the cathode structure according a further embodiment of the present invention.
Figure 4B:
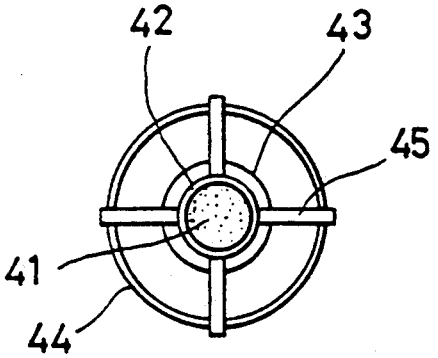
FIG. 4B is a plane view of the cathode structure of FIG. 4A.

In a further embodiment of FIGS. 4A and 4B, the cathode cup 42 containing the impregnate pellet 41 is fixed to the upper end of the cathode sleeve, and has metal ribbons 45 extended from the bottom. The lower ends of the metal ribbons 45 are fixed to the upper end of the cathode holder.

Thus, the cathode cup 32, 42 is fixed to the upper end of the cathode sleeve 33, 43, and the metal ribbons 35, 45 are extended from the side wall or bottom of the cathode cup 32, 42. Further the cathode sleeve is made of Ni-Cr alloy, and blackened reducing the screen image appearing time. The metal ribbons are made of a refractory metal such as Mo fixed to the upper end of the cathode sleeve, so that the thermal expansion of the length of the cathode sleeve occurs towards the lower end.

Consequently, even if the cathode sleeve is thermally expanded by the heat transferred from the heater, the expansion occurs towards the lower end of the cathode sleeve because the refractory metal ribbons are fixed to the upper end of the cathode sleeve, so that the gap between the pellet and the first electrode of the electron gun remains constant stabilizing the cathode current and thus the screen image.

Furthermore, the cathode sleeve is made of Ni-Cr alloy instead of Mo or Ta used in the conventional one, and therefore is easily blackened. Thus, the blackened cathode sleeve receives an increased heat transferred from the heater so as to reduce the time being taken for the image to appear on the screen. In addition, a plurality of the metal ribbons for connecting the cathode sleeve to the cathode holder are made of a good refractory metal such as Mo and Ta, fixed to the upper side wall of the cathode sleeve, so that the thermal expansion of the cathode sleeve due to the high cathode temperature does not affect the cathode current, thus stabilizing it.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

What is claimed is:

1. A cathode structure for a cathode ray tube comprising:

a cathode cup containing an electron emissive substance for emitting thermal electrons;

a cathode sleeve having an upper end and fixedly holding said cathode cup to transfer the heat from a heat source to said cathode cup;

a cathode holder having an upper end and a lower end for holding said cathode sleeve outwardly; and a plurality of metal ribbons for supporting said cathode sleeve, said ribbons being integrally formed with said cathode cup with first upper ends connected to said cup and second lower free ends fixed to the upper end of said cathode holder, thereby causing thermal expansion of said cathode sleeve to occur towards said cathode holder so as to maintain a constant gap between said cathode cup and a first electrode of an electron gun.

* * * * *